US008530794B2

(12) United States Patent
Shami et al.

(10) Patent No.: US 8,530,794 B2
(45) **Date of Patent: *Sep. 10, 2013**

(54) HAIR IRON

(75) Inventors: Farouk M. Shami, The Woodlands, TX (US); Dennis R. Morrison, Seabrook, TX (US); Thong Thu Pham, Houston, TX (US)

(73) Assignee: Farouk Systems, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/296,893

(22) Filed: Nov. 15, 2011

(65) Prior Publication Data

US 2012/0061370 A1 Mar. 15, 2012

Related U.S. Application Data

(63) Continuation of application No. 12/546,618, filed on Aug. 24, 2009, now Pat. No. 8,080,764.

(60) Provisional application No. 61/091,382, filed on Aug. 23, 2008, provisional application No. 61/142,565, filed on Jan. 5, 2009.

(51) Int. Cl.

| | |
|---|---|
| ***A45D 1/04*** | (2006.01) |
| ***A45D 1/06*** | (2006.01) |
| ***H05B 3/06*** | (2006.01) |
| ***H05B 3/26*** | (2006.01) |

(52) U.S. Cl.

USPC ..... 219/225; 132/224

(58) Field of Classification Search

None

See application file for complete search history.

(56) References Cited

U.S. PATENT DOCUMENTS

| | | | | |
|---|---|---|---|---|
| 4,263,500 | A | 4/1981 | Springer et al. | |
| 4,314,137 | A * | 2/1982 | Dorn | 219/222 |
| 4,739,151 | A * | 4/1988 | Smal | 219/225 |
| 5,890,290 | A * | 4/1999 | Davis | 30/2 |
| 6,205,677 | B1 | 3/2001 | Yune | |
| 6,223,753 | B1 * | 5/2001 | Lo | 132/224 |
| 6,449,870 | B1 | 9/2002 | Perez et al. | |
| 6,653,599 | B2 * | 11/2003 | Nam | 219/222 |

(Continued)

FOREIGN PATENT DOCUMENTS

| | | |
|---|---|---|
| GB | 2211419 A | 7/1989 |
| WO | WO 00/00055 A2 | 1/2000 |
| WO | WO 02/21967 A1 | 3/2002 |
| WO | WO 2004/030491 A1 | 4/2004 |

OTHER PUBLICATIONS

Patent Cooperation Treaty; PCT International Search Report Issued in Connection with International Application No. PCT/US2011/024790; Oct. 5, 2011; 6 pages; Europe.

(Continued)

*Primary Examiner* — Joseph M Pelham

(74) *Attorney, Agent, or Firm* — George P. Kobler; Lanier Ford Shaver & Payne P.C.

(57) ABSTRACT

A hair iron apparatus preferably includes an upper housing pivotally associated with a lower housing. A first heat transfer plate is associated with the upper housing and a second heat transfer plate is associated with the lower housing. A first heater is affixed to the first heat transfer plate by a first adhesive, and a second heater is affixed to the second heat transfer plate by a second adhesive.

20 Claims, 2 Drawing Sheets

(56) References Cited

U.S. PATENT DOCUMENTS

| | | | | |
|---|---|---|---|---|
| 7,465,904 | B2 * | 12/2008 | Kim et al. | 219/222 |
| 7,540,289 | B2 * | 6/2009 | Habibi | 132/224 |
| RE41,321 | E * | 5/2010 | Okumoto et al. | 132/224 |
| 8,080,764 | B2 * | 12/2011 | Shami et al. | 219/225 |
| 2002/0108264 | A1 | 8/2002 | Perez et al. | |
| 2005/0011533 | A1 * | 1/2005 | Ruben | 132/230 |
| 2005/0051188 | A1 * | 3/2005 | Leung | 132/224 |
| 2008/0041409 | A1 * | 2/2008 | Leung | 132/224 |
| 2009/0000141 | A1 | 1/2009 | Gross | |
| 2009/0084396 | A1 * | 4/2009 | Jerome et al. | 132/224 |

OTHER PUBLICATIONS

Patent Cooperation Treaty; PCT Written Opinion of the International Searching Authority issued in connection with International Application No. PCT/US2011/024790; Oct. 5, 2011, 8 pp; Europe.

* cited by examiner

HAIR IRON

CROSS REFERENCE TO RELATED APPLICATIONS

This application is a continuation of prior U.S. patent application Ser. No. 12/546,618, filed on Aug. 24, 2009 now U.S. Pat. No. 8,080,764, which claims the benefit and priority benefit, of U.S. Provisional Patent Application No. 61/091,382 filed on Aug. 23, 2008 and U.S. Provisional Patent Application No. 61/142,565 filed on Jan. 5, 2009, the contents of each prior application is hereby incorporated by reference in full.

BACKGROUND OF THE INVENTION

1. Field of the Invention

The present invention relates generally to the care and treatment of the hair, and in particular to a digital hair iron for styling, curling, flattening, and/or straightening hair.

2. Description of the Related Art

There has long been a desire to style, flatten curl, and/or straighten hair. Prior hair irons are generally known.

SUMMARY OF THE INVENTION

A hair iron apparatus preferably includes an upper housing pivotally associated with a lower housing. A first heat transfer plate may be associated with the upper housing and a second heat transfer plate may be associated with the lower housing. A first heater may be affixed to the first heat transfer plate by a first adhesive, and a second heater may be affixed to the second heat transfer plate by a second adhesive.

While the invention will be described in connection with the preferred illustrative embodiments, it will be understood that it is not intended to limit the invention to those embodiments. On the contrary, it is intended to cover all alternatives, modifications, and equivalents as may be included within the spirit and scope of the invention as defined by the appended claims.

BRIEF DESCRIPTION OF THE DRAWING

The present digital hair iron and method of using a digital hair iron may be understood by reference to the following description taken in conjunction with the accompanying drawing, in which.

DETAILED DESCRIPTION

Figure 1:
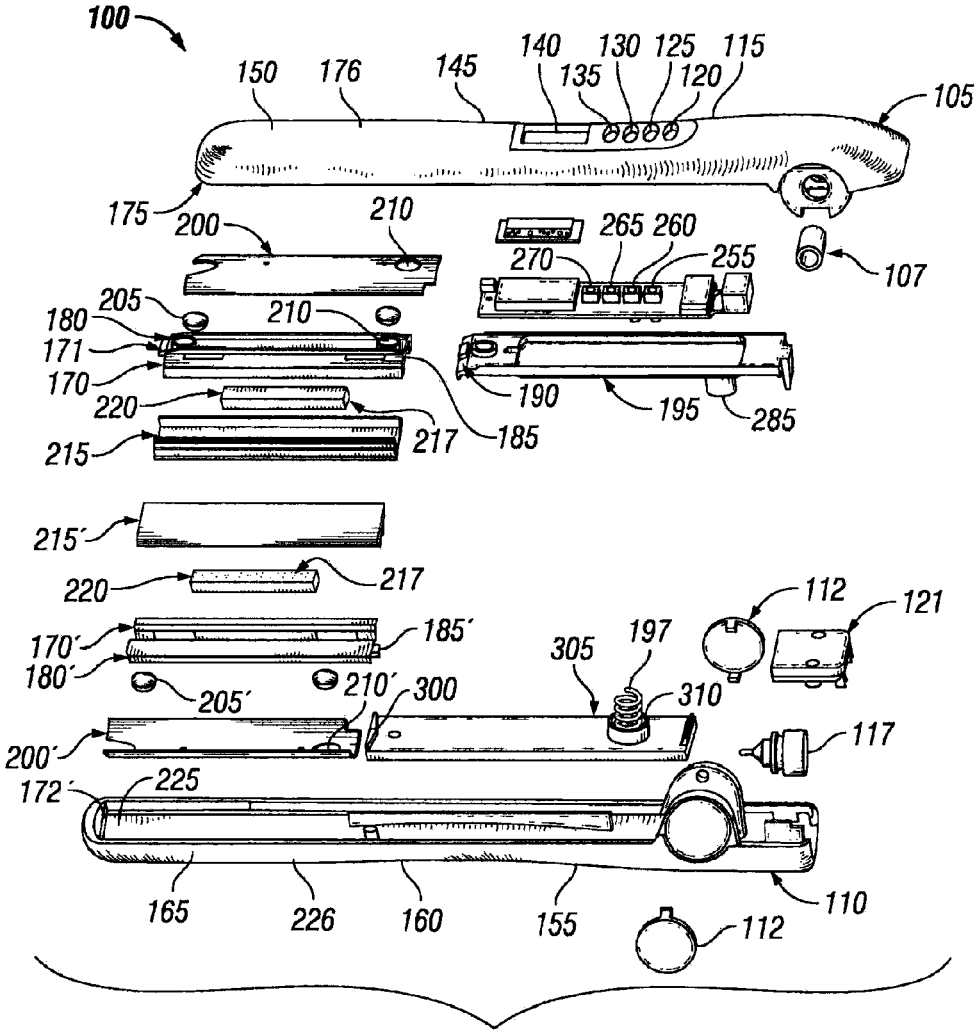
FIG. 1 is an exploded, side view of a hair iron according to an illustrative embodiment of the present digital hair iron.

With reference to FIG. 1, an exploded, side view of a hair iron 100 is illustrated. The hair iron 100 includes an upper housing 105 associated with a lower housing 110, as by being pivotally connectable about a first axis to the lower housing 110. The upper housing 105 and low housing 110 may each have a general convex outer shape, and a general concave inner shape. The upper housing 105 may include a first top side 176, a first underside 175, a first forward (or first front) portion 150, and a first rearward (or first rear) portion 115.

The lower housing 110 may include a second top side 226, a second underside 225, a second forward (or second front) portion 165, and a second rearward (or second rear) portion 155. Preferably, when pivotally connected, the upper housing 105 is aligned with, and opposes, the lower housing 110 in an elongated clam configuration. The pivotal engagement between the upper housing 105 and lower housing 110 may include a pivot shaft 107 and may be secured with at least two side caps 112.

A rearward portion 115 of the upper housing 105, may include any number of apertures through which any number of buttons, dials, switches, liquid crystal displays ("LCD"), and the like may be exposed. The rearward portion 115 of the upper housing 105, may include at least three, and preferably four button apertures 120, 125, 130, and 135, for buttons and at least one LCD aperture 140 for an LCD 250. In a further embodiment, the rearward portion 115 of the upper housing 105 blends along a slight upper rise 145 to the forward portion 150 of the upper housing 105. The end user may utilize the blended upper rise 145 as a thumb rest. Similarly, a rearward portion 155 of the lower housing 110 may blend along a slight lower rise 160 to the forward portion 165 of the lower housing 105. The end user may utilize the blended lower rise 160 as an index finger rest. The upper housing 105 and lower housing 110 may be made of any suitable material having the requisite strength and heat resistance properties to function in a hair iron, such as any suitable metal, metal alloy, or plastic material. Preferably blended plastic including at least about 30% fiberglass reinforcement may be utilized as the material of construction for the upper housing 105 and lower housing 110.

In an illustrative embodiment, a heater support 170 is affixed to the underside 175 of the forward portion 150 of the upper housing 105. A male element or tab 171 of the heater support 170 may slidingly engage a female slot or element (not shown) of the underside 175 of the forward portion 150 of the upper housing 105. Alternatively, the heater support 170 may be screwed or pinned to the underside 175 of the forward portion 150 of the upper housing 105. In a still further embodiment, a forward end 180 of the heater support 170 may slidingly engage the underside 175 of the forward portion 150 of the upper housing 105 with male and female tabs elements, and a reward end 185 of the heater support 170 may slidingly engage a forward end 190 of a top cover 195 with male and female elements. The top cover 195 preferably houses many of the hair iron's electrical components between an interior surface of the top cover 195 and the concave underside 175 of the reward portion 115 of the upper housing 105, as further detailed below. The heater support 170 may be made of any suitable material having the requisite strength and heat resistance properties to function in a hair iron, such as any suitable metal, metal alloy, or plastic material. Preferably blended plastic including at least about 40% fiberglass reinforcement may be utilized as the material of construction for the heater support 170. Preferably, the heater support 170 is made from a plastic having a higher fiberglass reinforcement percentage than the upper housing 105 and lower housing 110. Preferably, the heater support 170 has a higher melting point than the upper housing 105 and lower housing 110.

In an embodiment, an insulator 200 is disposed between the underside 175 of the forward portion 150 of the upper housing 105 and the heater support 170. Without wishing to be bound by the theory, the insulator 200 may prevent the forward portion 150 of the upper housing 105 from becoming too hot to a human's touch, and may direct heat toward hair during use. The insulator 200 may be made of any suitable material having the requisite heat resistance properties to function in a hair iron, such as a foam, foam polymer, glass foam, or plastic material. Preferably, the insulator 200 may be a high temperature silicone bonded mica laminate. As non-limiting examples, the insulator 200 may be made from silica aerogel, carbon aerogel, alumina aerogel, or chalcogel. Preferably, the insulator 200 has a thermal conductivity of at most about 0.2 Watts/(meter*Kelvin).

In a still further embodiment, at least one, and preferably two rocker balls 205 are disposed between the underside 175 of the forward portion 150 of the upper housing 105, or if present the insulator 200, and the heater support 170. The underside 175 of the forward portion 150 of the upper housing 105, or if present the insulator 200, may include apertures, recesses, mounts, and the like 210 to receive the rocker balls 205. Similarly, the heater support 170 may include apertures, recesses, or mounts 210 to receive the rocker balls 205. The rocker balls 205 may be of any suitable material having the requisite strength and compressibility characteristics to function in a hair iron, such as a plastic material, a foam, a foam polymer, or soft silicone rubber. Preferably, the compressibility of the rocker balls 205 is between about 30 and about 90 (Durometer) shore A, alternatively between about 40 and about 80 (Durometer) shore A, and alternatively about 55 (Durometer) shore A, as tested according to ASTM D2240-05. Without wishing to be bound by the theory, the rocker balls 205 permit the heater support 170, and a heat transfer plate 215, to pivot about a second axis, which may assist styling hair. Preferably, the amount of pivotal movement is less than about 8 degrees, alternatively less than about 5 degrees, alternatively less than about 3 degrees. Additionally, without wishing to be bound by the theory, the rocker balls 205 may permit the heater support 170, and heat transfer plate 215, to pivot, or be compressed, about the first axis, which may provide a stronger grip on the hair and assist styling hair.

The heat transfer plate 215 is preferably made of a material with high thermal conductivity, such as aluminum, brass, copper, diamond, gold, silver, metal alloys, and the like. The heat transfer plate 215 is preferably affixed to the heater support 170. In an embodiment, the heat transfer plate 215 may be screwed into the heater support 170, and alternatively the heat transfer plate 215 is slideably engageable with the heater support 170.

The heat transfer plate 215 may be coated with a polysiloxane and ceramic composition. In an embodiment, the ceramic composition includes at least 16 metal ions in an organic solvent. In another embodiment, the ceramic composition includes at least 16 metal ions suspended in an organic solvent. The 16 metal ions of the ceramic composition may include aluminum, calcium, titanium, chromium, manganese, iron, copper, strontium, barium, lanthanum, cerium, praseodymium, neodymium, lead, thorium, and silicon. Preferably the ceramic composition includes about 10.5 aluminum normalized weight percent, based on the total weight percent of metal ions in the ceramic composition, and the normalized weight percent of aluminum may range from between about 0.1 to about 40 percent. Preferably the ceramic composition includes about 6.7 calcium normalized weight percent, based on the total weight percent of metal ions in the ceramic composition, and the normalized weight percent of calcium may range from between about 1 to about 35 percent. Preferably the ceramic composition includes about 15.4 titanium normalized weight percent, based on the total weight percent of metal ions in the ceramic composition, and the normalized weight percent of titanium may range from between about 5 to about 55 percent. Preferably the ceramic composition includes about 10 chromium normalized weight percent, based on the total weight percent of metal ions in the ceramic composition, and the normalized weight percent of chromium may range from between about 1 to about 35 percent. Preferably the ceramic composition includes about 1.9 manganese normalized weight percent, based on the total weight percent of metal ions in the ceramic composition, and the normalized weight percent of manganese may range from between about 0.1 to about 45 percent. Preferably the ceramic composition includes about 7.1 iron normalized weight percent, based on the total weight percent of metal ions in the ceramic composition, and the normalized weight percent of iron may range from between about 2 to about 45 percent. Preferably the ceramic composition includes about 4.1 copper normalized weight percent, based on the total weight percent of metal ions in the ceramic composition, and the normalized weight percent of copper may range from between about 2 to about 35 percent. Preferably the ceramic composition includes about 1.1 strontium normalized weight percent, based on the total weight percent of metal ions in the ceramic composition, and the normalized weight percent of strontium may range from between about 0.01 to about 10 percent. Preferably the ceramic composition includes about 22.1 barium normalized weight percent, based on the total weight percent of metal ions in the ceramic composition, and the normalized weight percent of barium may range from between about 3 to about 55 percent. Preferably the ceramic composition includes about 1.9 lanthanum normalized weight percent, based on the total weight percent of metal ions in the ceramic composition, and the normalized weight percent of lanthanum may range from between about 0.1 to about 5 percent. Preferably the ceramic composition includes about 3.6 cerium normalized weight percent, based on the total weight percent of metal ions in the ceramic composition, and the normalized weight percent of cerium may range from between about 0.1 to about 10 percent. Preferably the ceramic composition includes about 0.4 praseodymium normalized weight percent, based on the total weight percent of metal ions in the ceramic composition, and the normalized weight percent of praseodymium may range from between about 0.01 to about 5 percent. Preferably the ceramic composition includes about 1.3 neodymium normalized weight percent, based on the total weight percent of metal ions in the ceramic composition, and the normalized weight percent of neodymium may range from between about 0.2 to about 10 percent. Preferably the ceramic composition includes about 0.1 lead normalized weight percent, based on the total weight percent of metal ions in the ceramic composition, and the normalized weight percent of lead may range from between about 0.01 to about 3 percent. Preferably the ceramic composition includes about 1 thorium normalized weight percent, based on the total weight percent of metal ions in the ceramic composition, and the normalized weight percent of thorium may range from between about 0.01 to about 3 percent. Preferably the ceramic composition includes about 23.3 silicon normalized weight percent, based on the total weight percent of metal ions in the ceramic composition, and the normalized weight percent of silicon may range from between about 5 to about 45 percent.

In an embodiment, the heat transfer plate 215 may be coated with the polysiloxane and ceramic composition in accordance with one or more of the following steps: cleaning; surface etching; priming; application of ceramic composition; and coating of polysiloxane. The heat transfer plate 215 may be cleaned by fine surface abrasion; application of alcohol, acetone, organic solvent, or cleaning solution; or a combination thereof. In an embodiment, the heat transfer plate 215 need not be cleaned prior to application of surface etching. In another embodiment, the heat transfer plate 215 may be cleaned after surface etching.

The surface of the heat transfer plate 215 may be etched using a dilute phosphoric acid solution, or other suitable acidic or basic solutions. Without wishing to be bound by the theory, it is believed that surface etching creates minor cuts or pocks into the surface of the heat transfer plate 215, which improves the bond between the ceramic composition and the heat transfer plate 215 by increasing the surface area of the heat transfer plate 215 and/or increasing a friction fit between the heat transfer plate 215 and the ceramic composition.

An aqueous composition including potassium, sodium, aluminum, and ammonium silicate, or combinations thereof may be prepared and used as a primer. Without wishing to be bound by the theory, it is believed that application of the primer as a coating to the heat transfer plate 215 renders the metal surface of the heat transfer plate 215 hydrophilic. The heat transfer plate 215 coated with the primer may be heated to about 350° C. for about 15 to about 20 minutes. Alternatively, the heat transfer plate 215 coated with the primer is placed into an over which is heated to about 350° C. for about 15 to about 20 minutes.

Then, the heat transfer plate 215 may be cooled to about 90° C. to about 125° C. The cooled and primed heat transfer plate 215 may be sprayed or painted with a thin coat of ceramic composition. The ceramic composition may a mixture of at least the above-identified 16 metal ions in powered form (mesh #320-150) suspended in an organic solvent of alcohol or aliphatic solvents such as $C_2$ (ethanol or ethane) up to $C_{10}$ (dodecanol), including 2,3 dimethyl butane. A coating of polysiloxane, such as for example triethoxysilane ($(C_2H_5O)_3SiH$), may then be applied to the heat transfer plate 215. The coating of polysiloxane may be cured by heating the heat transfer plate 215 to about 200° C. to about 220° C. for between about 15 and about 20 minutes. Alternatively, the coating of polysiloxane may be cured by placing the heat transfer plate 215 into an oven which is heated to about 200° C. to about 220° C. for between about 15 and about 20 minutes Without wishing to be bound by the theory, it is believed that the heat transfer plate 215, coated as described above, may be used within a digital or analogue hair iron to create anions, or positive ions, when the coated heat transfer plate 215 is heated above 60° C. In an embodiment, the heater 220 is heated by high current and the heat is transferred through the thermal epoxy to the heat transfer plate 215. It is further believed that far infrared (thermal waves) are caused to be transferred through the ceramic composition and the anions, or positive ions, are transmitted to the hair having advantageous effects on the hair shaft, which make it more manageable.

Figure 2:
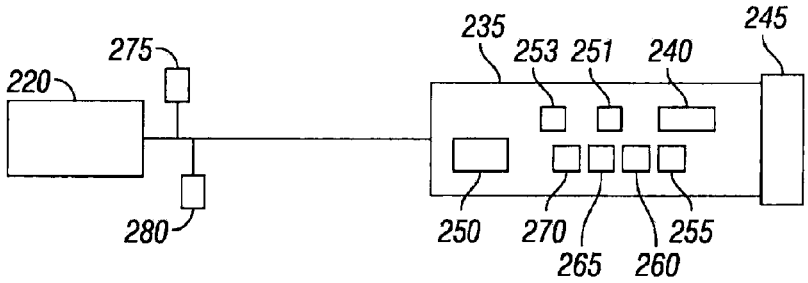
FIG. 2 is a schematic illustrating the circuitry of an illustrative embodiment of a digital hair iron according to an illustrative embodiment of the present digital hair iron.
Figure 3:
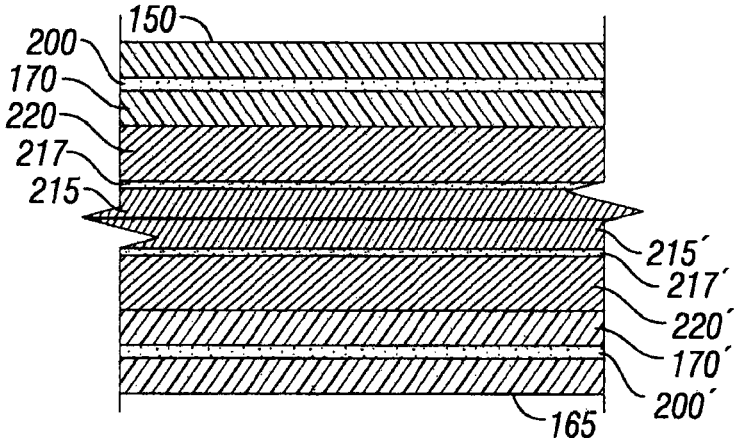
FIG. 3 is a partial cut-away front view of a hair iron, in a closed configuration, accordingly to an illustrative embodiment of the resent digital hair iron.

A heater 220 (shown in FIGS. 2 and 3) may be disposed between the heater support 170 and the heat transfer plate 215. An adhesive 217 may affix the heater 220 to the heat transfer plate 215. Preferably, the adhesive 217 is a thermally conductive epoxies. In an embodiment, with respect to FIG. 3, the insulator 200 may be associated with the first forward portion 150; the heater support 170 may be associated with the first insulator 200; the heater support 170 may be associated with the heat transfer plate 215; the heater 220 may be associated with the adhesive 217; and the heat transfer plate 215 may be associated with the heater 220. Without wishing to be bound by the theory, it is believed that the epoxy, adhesive 217 aids in the heat transfer between the heater 220 and the heat transfer plate 215, and beneficially eliminates the need for spring clamps and other mechanical elements, which may cause electrical disturbances. Further, without wishing to be bound by the theory, it is believed that the epoxy, adhesive 217 aids in promoting even heat transfer from the heater 220 to the heat transfer plate 215 and minimizes "cold spots." Preferably, the epoxy, adhesive 217 is applied as a uniform thin coating or film having a thickness ranging from between about 0.002 millimeters to about 0.5 millimeters, alternatively from about 0.002 millimeters to about 0.4 millimeters, and alternative from about 0.02 millimeters to about 0.3 millimeters. In an embodiment, a suitable epoxy, adhesive 217 includes Dow Corning 3-6752 silicone epoxy, which may have a thermal conductivity at 25° C. of about 1.8 watts per meter Kelvin, and a hardness (shore scale) of about 87A. The heater 220 may be made of any material having the requisite heat resistance and electrical properties to function in a hair iron, such as a metal, metal alloy, carbon, plastic, or ceramic.

In an embodiment, a second heater support 170' is affixed to the underside 225 of the forward portion 165 of the lower housing 110. A second male element or tab (not shown) of the second heater support 170' may slidingly engage second a female slot or element 172' the underside 225 of the forward portion 165 of the lower housing 110. Alternatively, the second heater support 170' may be screwed or pinned to the underside 225 of the forward portion 165 of the lower housing 110. In a still further embodiment, a lower forward end 180' of the second heater support 170' may slidingly engage the underside 225 of the forward portion 165 of the lower housing 110 with male and female elements, and a reward end 185' of the second heater support 170' may slidingly engage a forward end 300 of a lower cover 305 with male and female elements. The lower cover 305 preferably houses some of the hair iron's electrical components between itself 305 and the underside 225 of the reward portion 155 of the lower housing 110, as further detailed below. The second heater support 170' may be made of any suitable material having the requisite strength and heat resistance properties to function in a hair iron, such as any suitable metal, metal alloy, or plastic material. Preferably a blended plastic including at least about 40% fiberglass reinforcement may be utilized as the material of construction for the second heater support 170'. Preferably, the second heater support 170' is made from a plastic having a higher fiberglass reinforcement percentage than the upper housing 105 and lower housing 110. Preferably, the second heater support 170' has a higher melting point than the upper housing 105 and lower housing 110.

In an embodiment, a second insulator 200' is disposed between the underside 225 of the forward portion 165 of the lower housing 110 and the second heater support 170'. Without wishing to be bound by the theory, the second insulator 200' may prevent the forward portion 165 of the lower housing 110 from becoming too hot to a human's touch, and may direct heat toward hair during use. The second insulator 200' may be made of any suitable material having the requisite heat resistance properties to function in a hair iron, such as a foam, foam polymer, glass foam, or plastic material. Preferably, the second insulator 200' may be a high temperature silicone bonded mica laminate. As non-limiting examples, the second insulator 200' may be made from silica aerogel, carbon aerogel, alumina aerogel, or chalcogel. Preferably, the insulator 200' has a thermal conductivity of at most about 0.2 Watts/(meter*Kelvin).

In a still further embodiment, at least one, and preferably two lower rocker balls 205' are disposed between the underside 225 of the forward portion 165 of the lower housing 110, or if present the second insulator 200', and the second heater support 170'. The underside 175 of the forward portion 225 of the lower housing 110, or if present the second insulator 200', may include apertures, recesses, mounts, and the like 210' to receive the lower rocker balls 205'. Similarly, the second heater support 170' may include apertures, recesses, or mounts 210' to receive the lower rocker balls 205'. The lower rocker balls 205' may be made from a soft silicone rubber. Preferably, the compressibility of the lower rocker balls 205' is between about 30 and about 90 (Durometer) shore A, alternatively between about 40 and about 80 (Durometer) shore A, and alternatively about 55 (Durometer) shore A, as tested according to ASTM D2240-05. Without wishing to be bound by the theory, the lower rocker balls 205' permit the second heater support 170', and second heat transfer plate 215', to pivot about a second axis, which may assist styling hair. Preferably, the amount of pivotal movement is less than about 8 degrees, alternatively less than about 5 degrees, alternatively less than about 3 degrees. Additionally, without wishing to be bound by the theory, the lower rocker balls 205' may permit the second heater support 170', and second heat transfer plate 215', to pivot, or be compressed, about the first axis, which may provide a stronger grip on the hair and assist styling hair.

The second heat transfer plate 215' is preferably made of a material with high thermal conductivity, such as aluminum, brass, copper, diamond, gold, silver, metal alloys, and the like. The second heat transfer plate 215' is preferably coated with a polysiloxane and ceramic composition containing at least 16 metal ions and other organic composites. In an embodiment, the ceramic and at least 16 metal ions and other organic composites are suspended in the polysiloxane. The second heat transfer plate 215' is preferably affixed to the second heater support 170'. In an embodiment, the second heat transfer plate 215' may be screwed into the second heater support 170', and alternatively the second heat transfer plate 215' is slideably engageable with the second heater support 170'.

A second heater 220' (FIG. 3) may be disposed between the second heater support 170' and the second heat transfer plate 215'. A second adhesive 217' may affix the second heater 220' to the second heat transfer plate 215'. In an embodiment, with respect to FIG. 3, the second insulator 200' may be associated with the second forward portion 165; the second heater support 170' may be associated with the second insulator 200'; the second heater support 170' may be associated with the second heat transfer plate 215'; the second heater 220' may be associated with the second adhesive 217'; and the second heat transfer plate 215' may be associated with the second heater 220'. Without wishing to be bound by the theory, it is believed that the epoxy aids in the heat transfer between the second heater 220' and the second heat transfer plate 215', and beneficially eliminates the need for spring claims and other mechanical elements, which may cause electrical disturbances. Further, without wishing to be bound by the theory, it is believed that the epoxy aids in promoting even heat transfer from the second heater 220' to the heat transfer plate 215' and minimizes "cold spots." Preferably, the epoxy, or second adhesive 217', is applied as a uniform thin coating or film having a thickness ranging from between about 0.002 millimeters to about 0.5 millimeters, alternatively from about 0.002 millimeters to about 0.4 millimeters, and alternative from about 0.02 millimeters to about 0.3 millimeters. In an embodiment, a suitable epoxy includes Dow Corning 3-6752 silicone epoxy, which may have a thermal conductivity at 25° C. of about 1.8 watts per meter Kelvin, and a hardness (shore scale) of about 87A. The second heater 220' may be made of any material having the requisite heat resistance and electrical properties to function in a hair iron, such as a metal, metal alloy, carbon, plastic, or ceramic.

As stated above, the top cover 195 preferably houses many of the hair iron's electrical components between itself 195 and the underside 175 of the reward portion 115 of the upper housing 105. The top cover 195 may be screwed to the underside 175 of the rearward portion 115 of the upper housing 105. Alternatively, a reward portion 230 of the top cover 195 may slideably engage the underside 175 of the reward portion 115 of the upper housing with male and female tabs. In this embodiment, preferably an area of the top cover 195 near its forward end 190 is adapted to be screwed into the underside 175 of the rearward portion 115 of the upper housing 105. Accordingly, in this embodiment, the top cover 195 is affixed to the underside 175 of the rearward portion 115 of the upper housing 105 using only one screw.

The lower cover 305 may be screwed to the underside 225 of the rearward portion 155 of the lower housing 110. Alternatively, a reward portion 230' of the lower cover 305 may slideably engage the underside 225 of the reward portion 155 of the lower housing 110 with male and female tabs. In this embodiment, preferably an area of the lower cover 305 near its forward end 300 is adapted to be screwed into the underside 225 of the rearward portion 155 of the lower housing 110. Accordingly, in this embodiment, the lower cover 305 is affixed to the underside 225 of the rearward portion 155 of the lower housing 110 using only one screw.

The top cover 195 and lower cover 305 may each include a top spring housing 285 and a lower spring housing 310, respectively. The top and lower spring housings 285 and 310 may oppose each other in vertical alignment. When the hair iron 100 is assembled a spring, or biasing spring, 197, may be disposed within the top and lower spring housings 285 and 310. The spring 197 provides resistance and separates the upper housing 105 and lower housing 110, or biases the upper housing 105 and lower housing 110 apart from each other, until a user acts against the spring 197 force exerted by the spring. The top and lower spring housings 285 and 310 may be located at any point along the top cover 195 and lower cover 305; however, without wishing to be bound by the theory, they are preferably located toward the rear of the top cover 195 and lower cover 305 to provide leverage to the user.

Between the top cover 195 and upper housing 105 may be housed the following components: at least one circuit board 235, at least one microprocessor 240, at least one voltage regulator 245, at least one LCD 250, at least one audio buzzer 251, at least one current controller 253, at least three and preferably four buttons, 255, 260, 265, and 270, and all of which are in electrical communication with each other. Also in electrical communication with the aforementioned electrical components are the heater 220, the second heater 220', optionally at least one thermal fuse 275, optionally at least one lower thermal fuse 275', optionally at least one thermister 280, and optionally at least one lower thermister 280'. In an embodiment either or both of the thermal fuse 275 and the lower thermal fuse 275' are present. In an embodiment either or both of the thermister 280 and the lower thermister 280' are present. In an embodiment, the thermal fuse 275 is affixed to the heater 220 or heat transfer plate 215 by a suitable adhesive including a commercially available thermal conductive epoxy. In an embodiment, a suitable epoxy includes Dow Corning 441 silicone D4 epoxy, which may have a heat transit ratio of 1 watt per meter Kelvin and a hardness of about 40. In an embodiment, the lower thermal fuse 275' is affixed to the second heater 220' or second heat transfer plate 215' by a suitable adhesive including a commercially available thermal conductive epoxy. In an embodiment, a suitable epoxy includes Dow Corning 441 silicone D4 epoxy, which may have a heat transit ratio of 1 watt per meter Kelvin and a hardness of about 40. Preferably, the epoxy is applied as a uniform thin coating or film having a thickness ranging from between about 0.002 millimeters to about 0.5 millimeters, alternatively from about 0.002 millimeters to about 0.4 millimeters, and alternative from about 0.02 millimeters to about 0.3 millimeters.

In an embodiment, the voltage regulator 245 provides direct current to the microprocessor 240 and the LCD 250. The current regulator 253, as instructed by the microprocessor 240, regulates current to the heater 200 and/or 200'.

The LCD 250 is preferably in alignment with the LCD aperture, or window, 140 and the buttons 270, 265, 260, and 255 are preferably in alignment with the button apertures, or windows, 135, 130, 125, and 120. The buttons 270, 265, 260, and 255 may protrude through the button apertures 135, 130, 125, and 120. Preferably, the buttons 270, 265, 260, and 255 are level with or recessed within the button apertures 135, 130, 125, and 120. Without wishing to be bound by the theory, recessed buttons reduce the chance that the user unintentionally depresses a button. Moreover, it is preferred that the force to depress each button be high enough to minimize unintentional depression of the button, yet low enough to allow ease of depression. Accordingly, the force needed to depress each button may range from about 130 grams force to 310 grams force, alternatively from about 150 grams force to about 260 grams force, and alternatively about 260 grams force, plus or minus 50 grams force.

In an embodiment each button is assigned one main function: an up button 270, a down button 265, a mode button 260, and a power button 255; however, the order of buttons and their respective main functions may vary. As a non-limiting example, the order of buttons may be a mode button (corresponding to 270), an up button (corresponding to 265), a down button (corresponding to 260), and a power button (corresponding to 255). In an alternative embodiment, there are three buttons—an up button, a down button, and a power button—wherein depressing at least two of the buttons (preferably the up and down buttons) at the same time triggers the fourth mode function.

Depressing the power button 265 turns the hair iron 100 on and off. Depressing the mode button 260 allows the user to control various functions of the hair iron 100, including setting the hair iron 100 to automatically turn off after a set amount of time, sounding an alarm utilizing the audio buzzer 251 after a set amount of time, and the like. Depressing the mode button 260 also allows the user to observe various information, including the current temperature of the plates in degrees Fahrenheit, Centigrade, Kelvin, or Rankin, the total number of hours and/or minutes that the hair iron has been used, the total number of hours and/or minutes that the hair iron has been used during a session, as well as the serial number of the hair iron. The information is preferably displayed on the LCD 250.

Depending on the mode that the hair iron is in, depressing the up button 270 has different functions. For example, if the hair iron is in "temperature mode" depressing the up button 270 will increase the temperature of the heaters 220 by a set amount, as regulated by the microprocessor 240, typically one degree, five degrees, or any other desired increment of temperature. In an embodiment, each time the up button 270 is depressed the audio buzzer 251 may sound an "beep" indicating a change in temperature setting to the user. Similarly, if the hair iron is in "temperature mode" depressing the down button 265 will decrease the temperature of the heaters 220 by a set amount, as regulated by the microprocessor 240, typically one degree, five degrees, or any other desired increment of temperature. In an embodiment, each time the down button 265 is depressed the audio buzzer 251 may sound an "beep" indicating a change in temperature setting to the user. If the temperature sensor, thermister 280, fails and either heater 220 gets too hot, the respective thermal fuse 275 or 275' will trip causing the hair iron to turn off.

In another example, if the hair iron is in "timing mode" depressing the up button 270 will increase the amount of time that the hair iron will stay on before automatically shutting off, and depressing the down button 265 will decrease the amount of time that the hair iron will stay on before automatically shutting off. In an embodiment, each time the up button 270 or down button 265 is depressed the audio buzzer 251 may sound an "beep" indicating a change in timing setting to the user. In alternative embodiments, the buttons may be replaced by rotatable dials, switches, and the like.

A power cord (not shown) may be disposed in electrical communication with a power receiving module 117, which may be affixed to the upper housing 105 and/or lower housing lower housing 110 and provide electrical power via the voltage regulator 245 to the circuit board 235 and the remainder of the electrical components of the hair iron 100. Preferably, the power cord (not shown) is secured between the upper housing 105 and the lower housing 110 at their rearward ends. A power cap 121 may secure the power receiving module 117 to the lower housing 110, preferably by screwing the power cap 121 to the lower housing 110.

Specific embodiments of the present analogue and digital hair irons have been described and illustrated. It will be understood to those skilled in the art that changes and modifications may be made without departing from the spirit and scope of the inventions defined by the appended claims.

We claim:

1. A hair iron comprising:

an upper housing, having a first top side, a first underside, a first front portion, and a first rear portion, pivotally associated with a lower housing, having a second top side, a second underside, a second front portion, and a second rear portion;

a first heat transfer plate associated with the first underside;

the first heater support affixed to the first underside, wherein the first heater support slidingly engages a first heat transfer plate;

a first insulator, wherein the first insulator is disposed between the first underside and the first heater support;

a first heater associated with the first heat transfer plate;

a first adhesive disposed between the first heat transfer plate and the first heater;

the second heat transfer plate associated with the second underside;

a second heater support affixed to the second underside, wherein the second heater support slidingly engages a second heat transfer plate;

a second insulator, wherein the second insulator is disposed between the second underside and the second heater support;

a second heater associated with the second heat transfer plate; and a second adhesive disposed between the second heat transfer plate and the second heater.

2. The hair iron of claim 1, wherein the first adhesive and the second adhesive is a thermally conductive epoxy.

3. The hair iron of claim 2, wherein the first and second adhesive are applied as a thin film or coating having a thickness ranging between about 0.002 millimeters to about 0.5 millimeters.

4. The hair iron of claim 1 having a single circuit board disposed within the upper housing, wherein the single circuit board is in electrical communication with at least three buttons, a microprocessor, at least one liquid crystal display, a voltage regulator, an audio buzzer, and a current controller.

5. The hair iron of claim 1, wherein the pivotal connection between the upper housing and lower housing includes a pivot shaft and at least two side caps, and a spring disposed within a first spring housing affixed to the first underside and a second spring housing affixed to the second underside.

6. The hair iron of claim 1, wherein the first rear portion of the upper housing has at least four button apertures and at least one liquid crystal display aperture.

7. The hair iron of claim 1, wherein a first thermal fuse is associated with the first heat transfer plate and an epoxy is disposed between the first thermal fuse and the first heat transfer plate.

8. The hair iron of claim 1, wherein the upper housing and lower housing are made of a blended plastic having at least about 30% fiberglass reinforcement.

9. The hair iron of claim 1, wherein the first and second heater supports are made from a blended plastic including at least about 40% fiberglass reinforcement.

10. The hair iron of claim 1, wherein the first and second insulators are a high temperature silicone bonded mica laminate, having a thermal conductivity of at most about 0.2 Watts/(meter*Kelvin).

11. The hair iron of claim 10, wherein the first and second heat transfer plates are made of a metal selected from the group consisting of aluminum, brass, copper, diamond, gold, silver, metal alloys.

12. The hair iron of claim 11, further comprising the first heater disposed between the first heater support and the first heat transfer plate, and the second heater disposed between the first heater support and the first heat transfer plate, wherein the first heater is affixed to the first heater support by a thermal conductive epoxy, and the second heater is affixed to the second heater support by a thermal conductive epoxy.

13. The hair iron of claim 1, wherein the top cover is affixed to the underside of the first rear portion of the upper housing with one screw, and a lower cover is affixed to the underside of the second rear portion of the lower housing with one screw.

14. The hair iron of claim 4, wherein the single circuit board, at least four buttons, the microprocessor, the at least one liquid crystal display, and the voltage regulator are each housed between the upper housing and a top cover; the four buttons are in alignment with at least four button apertures and the at least one liquid crystal display is in alignment with at least one liquid crystal display aperture.

15. The hair iron of claim 14, wherein the four at least button apertures and the at least one liquid crystal display aperture are integral with the first rear portion of the upper housing.

16. The hair iron of claim 15, further comprising the first heater, a thermal fuse, and at least one thermister housed between the upper housing and the top cover wherein the first heater, the thermal fuse and the at least one thermister are in electrical communication with the at least one circuit board; and the second heater and at least one second thermal fuse are housed between the lower housing and a lower cover, wherein the second heater and at least one second thermal fuse are in electrical communication with the at least one circuit board.

17. The hair iron of claim 15, wherein between about 130 grams force to about 310 grams force is needed to depress each of the four buttons.

18. The hair iron of claim 17, wherein about 260 grams force, plus or minus 50 grams force, is needed to depress each of the four buttons.

19. The hair iron of claim 15, wherein a first of the at least four buttons is assigned an up function, a second of the at least four buttons is assigned a down function, a third of the at least four buttons is assigned a power function, and a fourth of the at least four buttons is assigned a mode function.

20. The hair iron of claim 1, wherein the first and second heat transfer plate are coated with a polysiloxane and ceramic composition, wherein the ceramic composition includes at least aluminum metal ions, calcium metal ions, titanium metal ions, chromium metal ions, manganese metal ions, iron metal ions, copper metal ions, strontium metal ions, barium metal ions, lanthanum metal ions, cerium metal ions, praseodymium metal ions, neodymium metal ions, lead metal ions, thorium metal ions, and silicon metal ions.

* * * * *